United States Patent [19]

Towns et al.

[11] Patent Number: 4,946,055

[45] Date of Patent: Aug. 7, 1990

[54] TAMPER INDICATING SCREW CAP

[76] Inventors: Edward J. Towns, 12 Woods End Rd., Flovham Park, N.J. 07932; Edward M. Brown, 128 Passaic Ave., Livingston, N.J. 07039

[21] Appl. No.: 462,551

[22] Filed: Jan. 9, 1990

[51] Int. Cl.[5] ..... B65D 41/34

[52] U.S. Cl. ..... 215/254; 215/341; 215/354

[58] Field of Search ..... 215/253, 254, 256, 341, 215/354, 250, 251, 252, 258, 329, 303; 206/277; 220/290

[56] References Cited

U.S. PATENT DOCUMENTS

| | | | |
|---|---|---|---|
| 2,582,721 | 1/1952 | Roshkind | 215/354 |
| 2,926,806 | 3/1960 | Streng et al. | 215/256 |
| 2,961,119 | 11/1960 | Leach | 215/252 |
| 3,371,814 | 3/1968 | Ruprecht | 215/46 |
| 3,549,038 | 12/1970 | Lohrer | 215/41 |
| 4,109,814 | 8/1978 | Rausing | 215/217 |
| 4,303,167 | 1/1981 | Mantinez | 215/256 |
| 4,307,821 | 12/1981 | McIntosh | 222/83 |
| 4,310,102 | 1/1982 | Walter | 220/288 |
| 4,322,011 | 3/1982 | Mumford | 215/270 |
| 4,489,845 | 12/1984 | Aichinger et al. | 215/329 |
| 4,526,283 | 7/1985 | Skinner | 215/256 |

*Primary Examiner*—Stephen Marcus
*Assistant Examiner*—Stephen Cronin
*Attorney, Agent, or Firm*—Charles E. Temko

[57] ABSTRACT

An improved synthetic resinous molded threaded cap for use on necked containers permitting initial press fit installation and subsequent threaded engagement. The cap is provided with a tear seal, an inner surface of which provides mutual engagement of an inwardly projecting rib with a corresponding rib on the container neck. Rupture of the tear seal removes this rib and allows the cap to be threadedly engaged by further axial displacement of the cap upon the neck. The cap may be molded with a feathered free edge to facilitate removal from a mold without damaging the rib.

5 Claims, 2 Drawing Sheets

TAMPER INDICATING SCREW CAP

RELATED APPLICATIONS

Reference is made to our previously filed applications, namely:

Ser. No. 193,260 Filed May 11, 1988, copending;

Ser. No. 273,598 Filed Nov. 21, 1988, now abandoned;

Ser. No. 273,598 Filed Nov. 21, 1988, copending;

each of which discloses and claims a related invention.

BACKGROUND OF THE INVENTION

This invention relates generally to the field of synthetic resinous closures for dispensing containers and the like, and more particularly to an improved form of "tamper evident" closure suitable for selectively closing such containers as tubes of toothpaste and other products which are the subject of tamper proof protection.

In our prior three applications, above identified, the problem involved in molding unitary synthetic resinous closures is extensively discussed, as is a process by which the closure may be molded in such manner as to include projections or rings on an inner surface of the closure which is spread from a free edge thereof to permit removal of the closure without damage to the projection or rings as they part contact with the core of the mold which has an undercut portion to form such projections. Of particular importance is the presence of an internal retaining ring which maintains the cap in engaged condition with the core until the skirt of the closure has been spread radially outward to a degree sufficient to permit disengagement with the undercut portion of the core. This concept has application to a wide range of types of closures and covers, and permits the development of closures which have heretofore been unavailable.

A rapidly expanding need is in the field of closures for collapsible dispensing tubes incorporating the provision of a "tamper evident" cap which will clearly indicate to the purchaser that the tube has been opened subsequent to filling and prior to acquisition by the purchaser. Caps of this type, even if partially captivated, are normally of threaded configuration, fitting rather tightly upon a relatively short correspondingly threaded neck in order to seal the contents of the container. Such caps are usually of relatively short axial length, and have a flat transversely extending end wall which overlies the free edge of the neck with reliance upon the threaded engagement of the neck and skirt or side wall of the cap to effect a sealing action. Such construction does not lend itself to the incorporation of a "tamper proof" or at least "tamper evident" auxiliary sealing means, and as a result resort is often made to a separate overlying sealing means which adds complexity and cost to the packaging. In order to be effective, such means must normally be capable of revealing relative movement between the closure and the container, which is not always possible in the case of a cap engaged by relative rotation.

SUMMARY OF THE INVENTION

Briefly stated, the invention contemplates the provision of an improved cap of the type referred to hereinabove, in which provision is incorporated of a seal which is so configured that it prevents removal of the cap once initially installed upon the neck of the container without first destroying the seal. The frangible structure is formed initially as the lower free edge portion of the side wall of the cap, and is capable of being spread radially after formation thereof on the core of the mold in the manner described in the above identified applications. Once the skirt portion has been manually removed, the cap is capable of being axially displaced with respect to the neck of the container to a point where mutually engageable threads on cap and neck are engaged in normal manner for subsequent opening and closing of the container. During the initial sealing, a centrally disposed sealing member supported from the inner surface of the transversely extending end wall engages the opening in the neck. This sealing element also serves the same function during the subsequent threaded engagement between cap and neck. The sealing member is of hollow configuration, and when filled with an amount of the contents of the container which remains in place, the filling has the effect of lessening the migration of more volatile components, such as flavorings through the synthetic resinous material which comprises the cap, after the container has been put into use.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
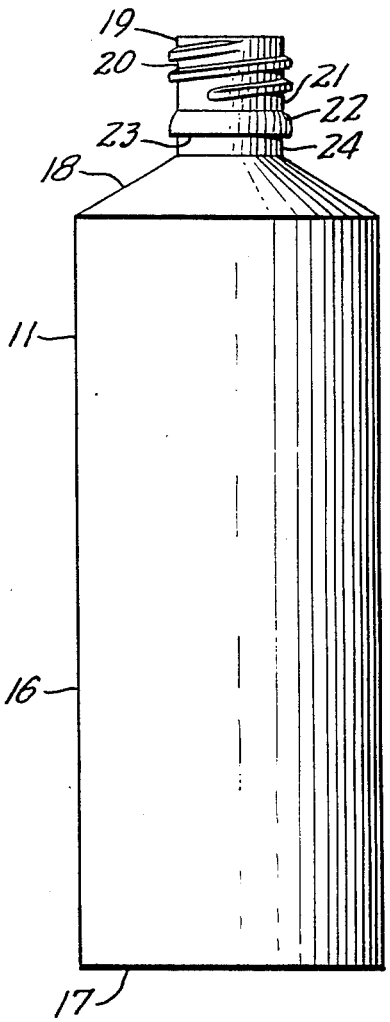
FIG. 1 is a side elevational view of a container element embodying the invention.
Figure 2:
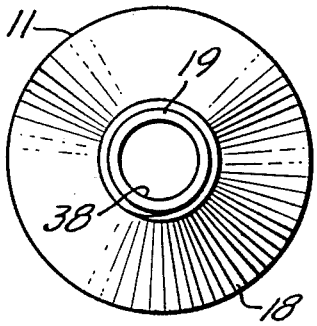
FIG. 2 is a top plan view thereof.
Figure 3:
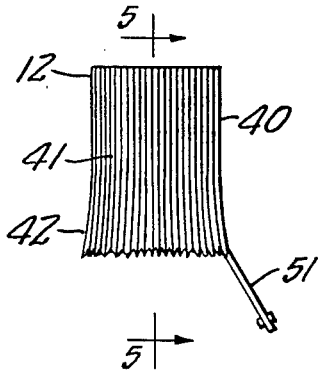
FIG. 3 is a side elevational view of a cap element embodying the invention.
Figure 5:
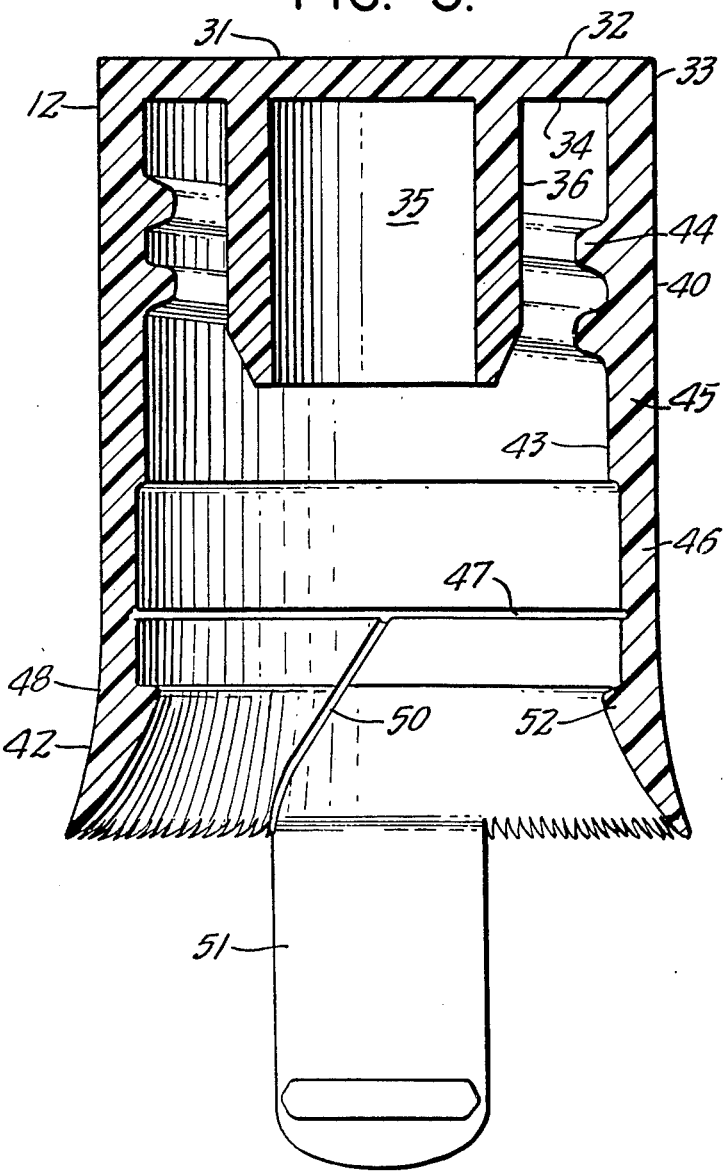
FIG. 5 is a longitudinal sectional view as seen from the plane 5—5 in FIG. 4.
Figure 4:
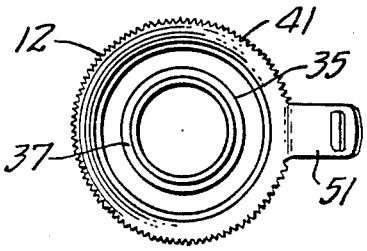
FIG. 4 is a bottom plan view of the cap element.
Figure 7:
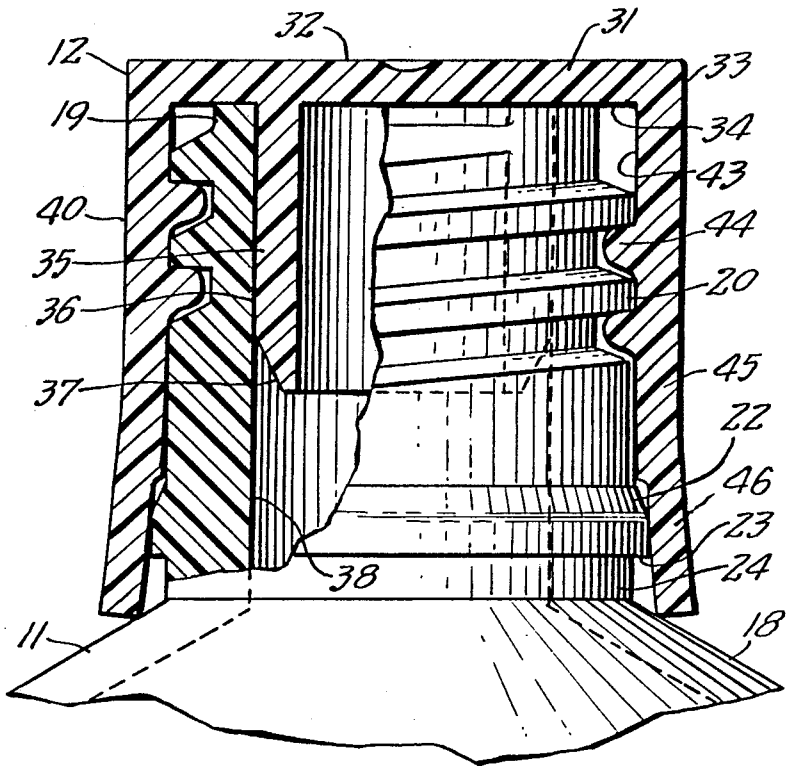
FIG. 7 is a side elevational view, partly in section, showing the engagement of the cap element with the container element after removal of a tear seal portion of the cap element.

In accordance with the invention, the device, generally indicated by reference character 10, comprises broadly, a dispensing container element 11 and a cap element 12 therefor.

The container element may be of relatively rigid bottle-like configuration, or collapsible, depending upon the nature of the contents, and includes a hollow main body 16 bounded by a distal end wall 17 and a proximal end wall 18 from which extends an axially directed neck element 19, somewhat greater in length than normal. The neck element includes an upper threaded portion 20, a medially disposed cylindrical portion 21, a conical rib portion 22 having an undercut surface 23, and a cylindrical portion 24 adjacent the rib portion 22. In the event that the main body 16 is collapsible, it may be formed either of soft metal or, preferably, of synthetic resinous materials.

The cap element 12 is also formed from suitable synthetic resinous materials, such as polyethylene, or other thermoplastic materials having similar properties. It includes an upper transverse wall 31 bounded by an outer surface 32, a peripheral edge 33, and an inner surface 34. Depending from the surface 34 is a centrally disposed hollow sealing member 35, the outer surface 36 of which is disposed at a one degree taper leading to a chamfered lower edge 37 to facilitate entry and sealing within the hollow interior 38 of the neck element 19.

Joining the transverse wall 31 is a cylindrical side wall 40 having a grooved outer surface 41 to facilitate manual engagement which terminates in a lower slightly flared skirt 42. An inner surface 43 includes a threaded section 44 surrounding the sealing member 35. Immediately therebelow is a thickened section 45, and a thinner section 46 having an annular groove 47 interconnecting a frangible section 48 therebelow.

The frangible section 48 includes an annularly disposed tear line 50 adjacent a manually engageable tab 51 as well as an internally directed rib 52.

Figure 6:
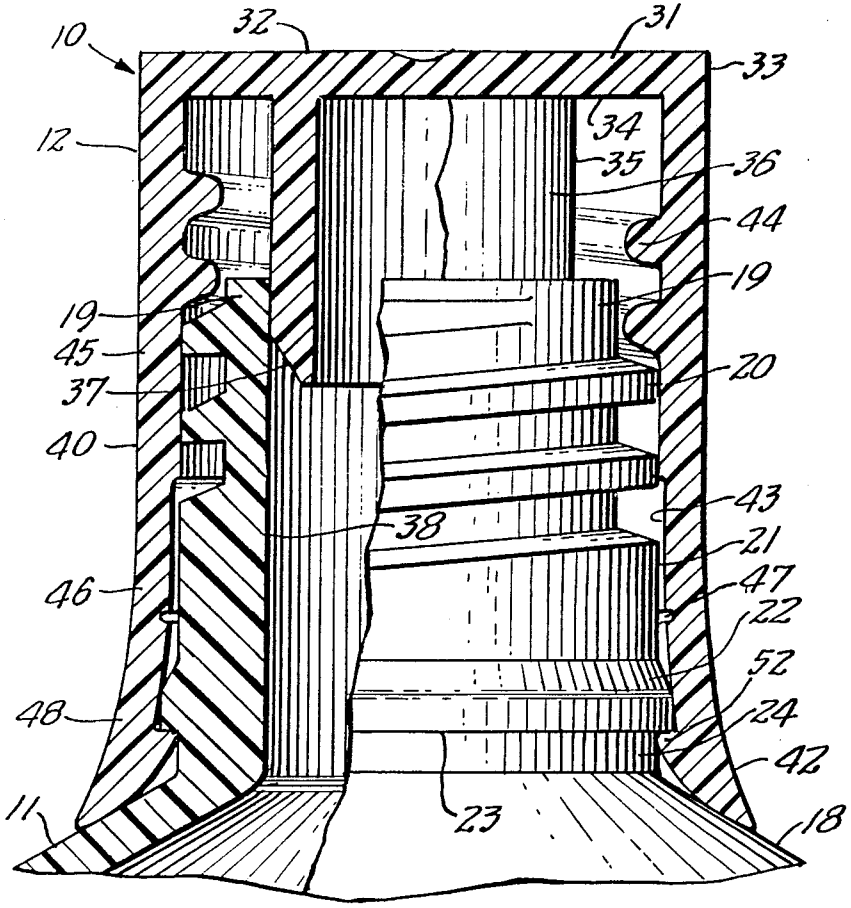
FIG. 6 is a side elevational view, partly in section, showing the initial engagement of the cap element with the contained element.

FIG. 6 illustrates the relative position of the component parts during initial engagement of the cap element with the container element. This condition results from a press fit operation requiring no threaded engagement, and can normally be accomplished by machinery which accomplishes the application of the cap to the container element during manufacture. In this condition, the rib 52 is positioned to engage the undercut surface 23 as a result of the resilient outward distortion of the skirt 42, and in this condition, the neck element is completely enclosed. Rotation of the cap element will not result in disengagement of the cap element from the neck element, which cannot be removed without either removal of the frangible section 48 or attempting to spread the skirt 42 which is not readily done without visibly damaging the skirt. It will be observed that in this initial condition, the sealing member 35 is of sufficient length to enter the hollow neck element and effect a sealing function against the contents of the container element.

The user may obtain access to the contents of the container element by removing the frangible section 48 using the tab 51, which disengages the undercut surface 23 and permits removal of the cap, either by directly pulling the same, or combining this with a rotating motion. When reclosure is desired, the remaining portions of the cap element are threadedly engaged in normal manner, this rotation resulting in moving the cap element in a direction toward the container element such that the edge defined by the groove 47 will now be at the same location as the lower edge of the skirt 42 was during the initial engagement. It will be observed that in either case, the sealing member 35 is of sufficient length to adequately engage the interior of the neck element, but with threaded engagement, the cap may be tightened sufficiently that the inner surface 34 engages the free end of the neck element and enhances this sealing action.

It may thus be seen that we have invented novel and highly useful improvements in container closures of screw cap type, the use of which permits "tamper indication" without resort to auxiliary indication means, and which also simplifies the initial installation of the cap upon the container without the necessity of using screw thread engagement which may be later employed by the user. The cap presents an attractive appearance in either the initial or subsequent engaged condition, and is so configured as to permit the use of advanced molding techniques which materially reduce the cost of fabrication. The corresponding neck element on the container, where the container is formed from synthetic resinous materials, may also be integrally molded with the container using standardized extrusion molding techniques. In both the initial and subsequent mutual engagement positions, a single sealing member which penetrates the neck of the container is positioned to effect a sealing action, while the inner surface of the side wall of the cap engages a frusto-conical ring on the outer surface of the neck to effect a further seal.

We wish it to be understood that we do not consider the invention to be limited to the precise details of structure shown and set forth in this specification, for obvious modifications will occur to those skilled in the art to which the invention pertains.

We claim:

1. An improved tamper-indicating screw cap closure construction comprising: a dispensing container having a hollow neck element at one end thereof, and a cap element selectively engageable upon said neck element; said neck element having a free end thereof and an outer generally cylindrical surface, a first portion of said cylindrical surface joining said free end having spiral threads thereon, a second adjacent portion of said cylindrical surface having a frusto-conically shaped rib thereon defining a radially extending undercut, and a third cylindrical portion of said cylindrical surface adjacent said rib; said cap being of flexible synthetic resinous material and having a transversely extending end wall bounded by a peripheral edge and outer and inner surfaces; said cap having a generally cylindrical side wall joining said upper wall at one end thereof and having inner and outer surfaces, said inner surface defining a first threaded portion adjacent said one end, a second medially positioned portion which is free of threads, and a third portion frangibly interconnected to said second portion, said third portion having a manually engageable tab for effecting disconnection; said third portion having an inwardly directed rib, and being resiliently radially distortable upon engagement with said rib on said neck element; whereby, upon initial engagement of said cap element with said neck element by relative axial movement, said inwardly directed rib is engaged with said frusto-conical rib on said neck element to effect an initial securement which can be dislodged only by removal of said third segment of said cap element, removal of said third segment allowing further relative axial movement and engagement of the threaded portion of said cap element with the threaded segment on said neck element to provide a selectively openable closure.

2. An improved cap closure construction in accordance with claim 1, in which said cap element, upon initial engagement, completely encloses said neck element.

3. An improved cap closure in accordance with claim 1, further characterized in said rib portion on said neck element contacts a smooth inner surface of said side wall of said cap element when said cap element is in threaded engagement with said neck element to provide an additional seal.

4. An improved cap closure in accordance with claim 1, in which said side wall of said cap element is radially resiliently flexible throughout its entire length.

5. An improved cap closure in accordance with claim 1, further characterized in said end wall is provided with a longitudinally extending sealing member which penetrates said neck element of sufficient axial length to perform a sealing function during both the initial engagement of the cap element and the threaded engagement thereof with said neck element.

* * * * *